US006704009B2

(12) United States Patent
Tachibana et al.

(10) Patent No.: US 6,704,009 B2
(45) Date of Patent: Mar. 9, 2004

(54) IMAGE DISPLAY

(75) Inventors: Miyuki Tachibana, Tokyo (JP); Hiroki Iwataka, Hyogo (JP)

(73) Assignee: NEC-Mitsubishi Electric Visual Systems Corporation, Tokyo (JP)

( * ) Notice: Subject to any disclaimer, the term of this patent is extended or adjusted under 35 U.S.C. 154(b) by 16 days.

(21) Appl. No.: 09/882,032

(22) Filed: Jun. 18, 2001

(65) Prior Publication Data

US 2002/0060671 A1 May 23, 2002

(30) Foreign Application Priority Data

Sep. 29, 2000 (JP) ..... P2000-298658

(51) Int. Cl.[7] ..... G09G 5/00
(52) U.S. Cl. ..... 345/213; 345/3.3
(58) Field of Search ..... 345/3.1, 3.3, 3.4, 345/698, 699, 98, 99, 100, 211, 212, 213

(56) References Cited

U.S. PATENT DOCUMENTS 5,111,190 A * 5/1992 Zenda ..... 345/3.4
6,037,925 A * 3/2000 Kim ..... 345/99
6,348,931 B1 * 2/2002 Suga et al. ..... 345/699

FOREIGN PATENT DOCUMENTS

JP 244586 9/1997

* cited by examiner

*Primary Examiner*—Xiao Wu
(74) *Attorney, Agent, or Firm*—Birch, Stewart, Kolasch & Birch, LLP

(57) ABSTRACT

An image display in which occurrence of beat noise can be suppressed without adding noise to an image in a pixel converting process is provided. The frequency of a data clock is preset to a value at which beat noise is not apt to occur (a value such that one of the dot clock frequency of the input analog video signal and the frequency of the data clock is not equal to or close to an integral multiple of the other) for each kind of the input analog video signal and is stored as a frequency correspondence list in a memory MM. In accordance with the kind of the input analog video signal, a control block 4 selects the set frequency of the data clock and allows a data clock generating block 6 to generate a data clock $C_d$. Consequently, at the time of a pixel converting process performed by a signal processing block 5, without adding noise to an image, occurrence of beat noise is suppressed.

20 Claims, 7 Drawing Sheets

IMAGE DISPLAY

BACKGROUND OF THE INVENTION

1. Field of the Invention

The present invention relates to a digital image display for converting an analog input video signal to a digital signal, performing signal processes such as pixel conversion on the digital signal, and transmitting the resultant signal to a display unit.

2. Description of the Background Art

For example, in an image display using a liquid crystal panel, a display unit as the liquid crystal panel portion requires a digitized video signal (digital video signal). Consequently, when a video signal supplied to such a digital image display is an analog signal, the analog video signal has to be A/D (analog-to-digital) converted. An example of the analog video signal which is supplied to the digital image display is a video output signal of a current personal computer or the like.

A sampling clock used at the time of the A/D conversion is generated from a vertical synchronizing signal and a horizontal synchronizing signal which are either included in the input analog video signal or extracted from the input analog video signal and separately supplied. Usually, the sampling clock is generated so that its frequency coincides with the frequency of a dot clock (clock specifying the period of a dot, used by a personal computer or the like to generate a video signal as a dot train) specifying the size of one pixel (dot) in the analog video signal.

The video signal converted to the digital signal is subjected to signal processes such as pixel conversion and picture quality adjustment before it is supplied to the display unit.

The pixel conversion denotes a process of enlarging or reducing an image, which is performed when the resolution (expressed by dots×lines) of the input analog video signal and that of the display unit do not coincide with each other. For example, when the resolution of the input analog video signal is 640 dots×480 lines and the resolution of the display unit is 1024 dots×768 lines, a process of enlarging an image (pixel conversion) by 1024/640 times in the horizontal direction and by 768/480 times in the vertical direction is performed on the input analog video signal and the resultant signal is transmitted to the display unit. As a result, the image is displayed fully on the screen of the display unit of 1024 dots×768 lines.

When the sampling clock used at the time of sampling the input analog video signal is used as it is at the time of the pixel conversion and the digital video signal is transmitted to the display unit, only data of the pixel amount of 640 dots×480 lines can be transmitted. In order to enable the data of the pixel amount of 1024 dots×768 lines to be transmitted to the display unit, it is necessary to newly generate a data clock of a frequency different from that of the sampling clock, which is adapted to the resolution of the display unit (that is, for specifying the resolution after the pixel converting process) and transmit the digital video signal by using the data clock to the display unit. As described above, in the digital image display, two kinds of clock signals (sampling clock and data clock) of different frequencies are used in the video signal process.

There are cases where noise occurs in the input analog video signal. When the noise has a component synchronized with the data clock, at the time of processing the digital video signal and transmitting the processed signal to the display unit, the noise component is also sampled and interference of stripes or the like, that is, what is called beat noise (regular noise) appears on the display screen. When the two kinds of clock signals of different frequencies as described above are generated in the proximity of one chip, the different clock frequencies interfere with each other and beat interference is apt to occur.

Obviously, the beat interference can be generally solved by separating an analog signal processing unit (A/D converter in the above example) from a digital signal processing unit. However, as the integration density of an IC (Integrated Circuit) increases, the analog signal processing unit and the digital signal processing unit are realized in a single IC. It is therefore difficult to separate the analog video signal processing unit from the digital video signal processing unit.

An example of an image display capable of suppressing occurrence of beat noise is disclosed in Japanese Patent Application Laid-Open No. 9-244586 (1997). FIG. 8 shows the configuration of the technique. Shown in FIG. 8 are a synchronization separating circuit 101 for separating a sync signal from a video input signal, a first phase comparator 102, a first LPF (Low Pass Filter) 103, a first VCO (Voltage Controlled Oscillator) 104, and a first counter 105. The first phase comparator 102, first LPF 103, first VCO 104, and first counter 105 construct a first PLL (Phase Locked Loop) 106.

Also shown in FIG. 8 are a pixel converting circuit 107 for enlarging or reducing an image, a second phase comparator 108, an adder 109, a second LPF 110, a second VCO 111, and a second counter 112. The second phase comparator 108, adder 109, second LPF 110, second VCO 111, and second counter 112 construct a second PLL 113.

Also shown in FIG. 8 are a timing generating circuit 114 for receiving a clock output from the second PLL 113 and generating various timings, a first frequency divider 115 for frequency-dividing a horizontal sync signal, a second frequency divider 116 for frequency-dividing a vertical sync signal, and an exclusive OR gate 117 for performing an exclusive OR operation on outputs from the first and second frequency dividers 115 and 116.

According to the technique, a composite video input signal supplied from the outside is supplied to the pixel converting circuit 107. The pixel converting circuit 107 performs the process of enlarging or reducing the video input signal by using a clock from the first PLL 106 (which is an output from the first VCO 104 and corresponds to the sampling clock) and a clock from the second PLL 113 (which is an output from the second VCO 111 and corresponds to the data clock).

By adding a voltage of a predetermined volume to the VCO control voltage of the second PLL 113 for generating a clock at the post stage every toggle cycle as the exclusive OR of the horizontal and vertical cycles, the video signal is modulated. That is, noise is added to an image in which beat interference is apt to appear, thereby making regular interference inconspicuous.

As noise is added to an image, however, the method as described above has a problem such that other adverse influences such as phase deviation (jitter) are apt to be exerted on the image.

SUMMARY OF THE INVENTION

According to a first aspect of the present invention, there is provided an image display having: an A/D converting unit for receiving an analog video signal and sampling the analog video signal by using a sampling clock, thereby converting the analog video signal into a first digital video signal; a signal processing unit for performing a pixel converting process on the first digital video signal by using a data clock for specifying resolution after the pixel converting process to thereby generate a second digital video signal; a display unit for receiving the second digital video signal and displaying an image; and a control unit for controlling generation of the sampling clock and generation of the data clock, wherein a frequency of the data clock is preset for each kind of the analog video signal, and the control unit selects the frequency of the data clock on the basis of the presetting at the time of controlling the generation of the data clock.

According to a second aspect of the invention, in the image display, the analog video signal is supplied as a dot train, and a frequency of a dot clock for specifying a period of the dot train of the analog video signal and a frequency of the data clock are set so that one of the frequencies does not become an integral multiple of the other.

According to a third aspect of the invention, in the image display, the control unit executes the selecting operation only after the analog video signal or a sync signal of the analog video signal continues to be the signal of the same image for a predetermined period.

According to a fourth aspect of the invention, the image display further has a writable storage device, and when the analog video signal or the sync signal of the analog video signal continues to be the signal of the same image for a predetermined period, the preset information based on which the control unit performs the selecting operation is stored in the storage device, and only when the image display is operated again, the control unit executes the selecting operation on the basis of the information.

According to a fifth aspect of the invention, in the image display, when the set information based on which the control unit performs the selecting operation is already stored in the storage device, the preset information is updated and stored in the storage device each time the analog video signal or the sync signal continues to be the signal of the same image for a predetermined period.

According to a sixth aspect of the invention, in the image display, when the preset information based on which the control unit performs the selecting operation is already stored in the storage device, each time the analog video signal or the sync signal continues to be the signal of the same image for a predetermined period, new information is compared with the information already stored, and when the new information is different from the information already stored, the storage device is updated to the new information.

According to a seventh aspect of the invention, the image display further has an input signal discriminating unit for receiving the sync signal of the analog video signal, discriminating the kind of the analog video signal from the sync signal, and transmitting the discrimination result to the control unit, and the control unit executes the selecting operation by using the discrimination result.

According to an eighth aspect of the invention, in the image display, the input signal discriminating unit further estimates resolution of the analog video signal from the sync signal, and discriminates the kind of the analog video signal by also using information of the resolution.

According to a ninth aspect of the invention, the image display further has a sampling clock generating unit for generating the sampling clock under control of the control unit on the basis of the discrimination result; and a data clock generating unit for generating the data clock under control of the control unit on the basis of the discrimination result.

According to a tenth aspect of the invention, the image display further includes a storage device, and information of the frequency of the data clock preset for each kind of the analog video signal is stored as a frequency correspondence list in the storage device.

According to the first aspect, the frequency of the data clock is preset for each kind of the analog video signal, and the control unit selects the frequency of the data clock on the basis of the presetting at the time of controlling the generation of the data clock. Consequently, by presetting the data clock frequency at which beat noise is not easily caused for each kind of the analog video signal, the image display in which the occurrence of beat noise can be suppressed without adding noise to an image is achieved.

According to the second aspect, the frequency of the dot clock and the frequency of the data clock are set so that one of the frequencies does not become an integral multiple of the other, so that the occurrence of beat noise is more suppressed.

According to the third aspect, since the control unit executes the selecting operation only after the analog video signal or a sync signal of the analog video signal continues to be the signal of the same image for a predetermined period, in the case where the input signal is switched in extremely short time like at the time of start of a personal computer, the display screen can be prevented from being disturbed or remaining black to hide a disturbed screen.

According to the fourth aspect, when the analog video signal or the sync signal of the analog video signal continues to be the signal of the same image for a predetermined period, the preset information based on which the control unit performs the selecting operation is stored in the storage device, and only when the image display is operated again, the control unit executes the selecting operation on the basis of the information. Consequently, even when the user of the image display performs the process of switching the frequency of the data clock, the disturbed display screen is not shown to the user at that time point. It does not therefore make the user feel offensive or misconstrue the disturbed display screen as a failure in the image display.

According to the fifth aspect, when the set information based on which the control unit performs the selecting operation is already stored in the storage device, the preset information is updated and stored in the storage device each time the analog video signal or the sync signal continues to be the signal of the same image for a predetermined period. When the user of the image display newly switches the kind of the analog video signal, the latest frequency of the data clock can be set.

According to the sixth aspect, when the preset information based on which the control unit performs the selecting operation is already stored in the storage device, each time the analog video signal or the sync signal continues to be the signal of the same image for a predetermined period, new information is compared with the information already stored, and when the new information is different from the information already stored, the storage device is updated to the new information. Therefore, when the user of the image display switches the kind of the analog video signal, the latest frequency of the data clock can be set.

According to the seventh aspect, the input signal discriminating unit discriminates the kind of the analog video signal from the sync signal, and the control unit executes the selecting operation by using the discrimination result. Thus, the frequency according to the kind of the analog video signal can be accurately selected.

According to the eighth aspect, the input signal discriminating unit further estimates resolution of the analog video signal from the sync signal, and discriminates the kind of the analog video signal by also using information of the resolution. Thus, the frequency according to the kind of the analog video signal can be accurately selected.

According to the ninth aspect, the information of the frequency of the data clock preset for each kind of the analog video signal is stored as a frequency correspondence list in the storage device. By referring to the frequency correspondence list, the control unit can accurately select the frequency according to the kind of the analog video signal.

According to the tenth aspect, the frequency can be arbitrarily set irrespective of the preset frequency of the data clock for each kind of the analog video signal. Consequently, the user of the image display can set the frequency of the data clock in an optimum state while checking the image and the state of the beat noise.

The object of the invention is to provide an image display in which occurrence of beat noise can be suppressed without adding noise to an image.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

A first preferred embodiment is to realize an image display in which the frequency of a data clock is preset to a value at which beat noise does not easily occur for each kind of an input analog video signal, stored in a frequency correspondence list, and selected according to the kind of an input analog video signal, thereby enabling occurrence of the beat noise to be suppressed without adding noise to an image.

Figure 1:
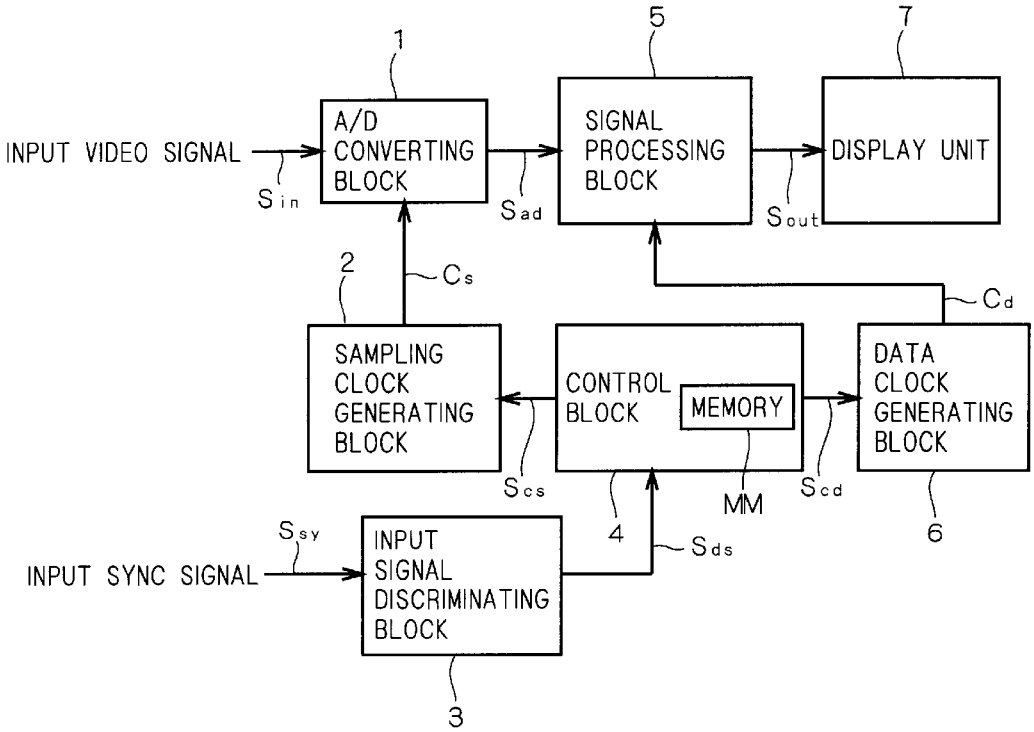
FIG. 1 is a diagram showing an image display according to a first preferred embodiment.

FIG. 1 is a diagram showing the image display according to the first preferred embodiment of the invention. Shown in FIG. 1 are an A/D converting block 1 for converting an input analog video signal $S_{in}$ supplied as a dot train into a digital video signal $S_{ad}$, a sampling clock generating block 2 for generating a sampling clock $C_s$, an input signal discriminating block 3 for discriminating the kind of the input analog video signal $S_{in}$ (kind such as VGA or XGA), a control block 4 for outputting control information $S_{cs}$ and $S_{cd}$ for controlling generation of the sampling clock $C_s$ and a data clock $C_d$, a signal processing block 5 for performing signal processes such as a pixel converting process on the digital video signal $S_{ad}$ and outputting the processed signal as a digital video signal $S_{out}$, a data clock generating block 6 for generating the data clock $C_d$ for specifying the resolution after the pixel converting process, and a display unit 7 such as a liquid crystal panel portion.

The operation of the image display will be described hereinbelow. First, the input analog video signal $S_{in}$ is supplied to the A/D converting block 1 and sampled to the digital video signal $S_{ad}$.

Figure 2:
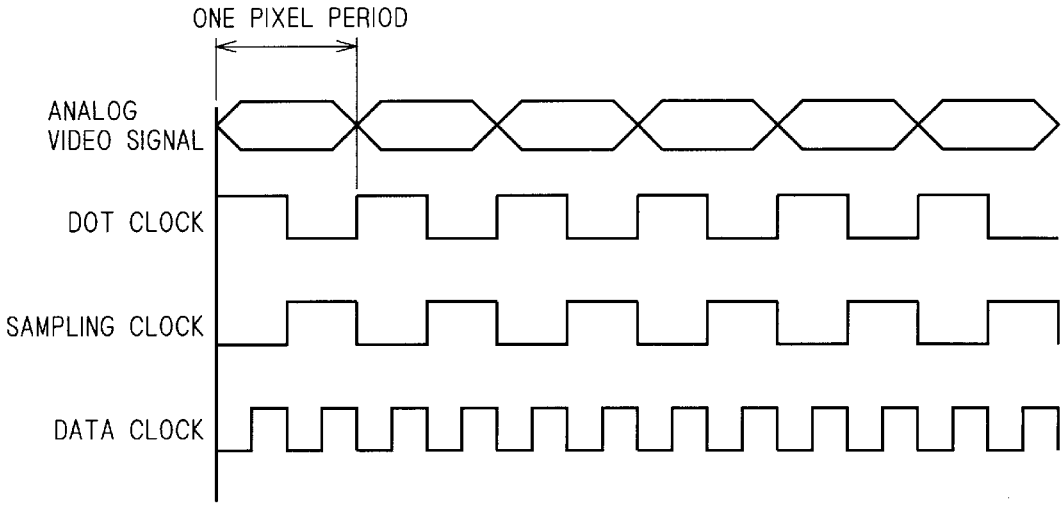
FIG. 2 is a diagram showing the relations of an analog video signal, a dot clock, a sampling clock, and a data clock.

The sampling clock $C_s$ used for the A/D conversion is generated as follows. From a sync signal $S_{sy}$ (horizontal and vertical sync signals) of the input analog video signal $S_{in}$, which is supplied together with the input analog video signal $S_{in}$, the input signal discriminating block 3 discriminates the polarity of the sync signal $S_{sy}$ and measures the frequency of each of the horizontal and vertical sync signals. On the basis of the result, the kind of the input analog video signal is discriminated and information of the discrimination result is outputted as a signal $S_{ds}$. On the basis of the signal $S_{ds}$, the control block 4 controls the sampling clock generating block 2 by using the control information $S_{cs}$. The sampling clock generating block 2 receives the control information $S_{cs}$ and generates the sampling clock $C_s$ of a frequency which coincides with the frequency of the dot clock of the analog video signal as shown in FIG. 2 (although the case where the phase of the dot clock and that of the sampling clock are deviated from each other by 180 degrees is shown in FIG. 2, it is just an example and the invention is not limited to the example).

On the basis of the discrimination result of the input analog video signal $S_{in}$ the control block 4 determines the frequency of the data clock $C_d$ at which beat noise does not easily occur with respect to the sampling clock $C_s$, and controls the data clock generating block 6 by the control information $S_{cd}$. The data clock generating block 6 receives the control information $S_{cd}$ and generates the data clock $C_d$ as shown in FIG. 2 (although the case where the frequency of the data clock is twice as high as the frequency of the sampling clock is shown in FIG. 2, it is just an example and the invention is not limited to the example). The "frequency of the data clock $C_d$ at which beat noise does not easily occur" will be described hereinlater.

The data clock $C_d$ is supplied to the signal processing block 5 where the digital video signal $S_{ad}$ is subjected to signal processes such as the pixel converting process and picture quality adjustment. The processed digital video signal $S_{out}$ is outputted from the signal processing block 5 to the display unit 7 and an image is displayed on the display unit 7.

The beat noise is apt to be conspicuous when one of the frequency of the data clock $C_d$ and the frequency of the dot clock specifying the period of the dot train of the analog video signal $S_{in}$ (which coincides with the frequency of the sampling clock $C_s$) is equal to or close to an integral multiple of the other. Consequently, at the time of generating the data clock $C_d$, the frequency which does not satisfy the condition should be selected.

In this case, it is sufficient to obtain the kind of the input analog video signal $S_{in}$ and the frequency adapted to the data clock $C_d$ to be used for each kind of the analog video signal by experiments or simulation, preset the corresponding relation, and store the corresponding relation as a frequency correspondence list in a memory MM in the control block 4. With reference to the frequency correspondence list, the control block 4 selects the frequency of the data clock $C_d$ to be used in accordance with the kind of the input analog video signal. In such a manner, by referring to the frequency correspondence list, the control block 4 can properly select the data clock frequency adapted to the kind of the analog video signal.

An example of such a frequency correspondence list is shown in Table 1.

TABLE 1

| Kind of input video signal | Dot clock [MHz] | Horizontal sync frequency [KHz] | Vertical sync frequency [Hz] | Data clock [MHz] |
|---|---|---|---|---|
| MAC13 | 30.24 | 35 | 66.67 | 37.5 |
| MAC16 | 57.24 | 49.69 | 74.49 | 35 |
| VGA350 | 25.18 | 31.47 | 70.08 | 35 |
| VGA60 | 25.18 | 31.47 | 59.94 | 35 |
| VGA75 | 31.5 | 37.5 | 75 | 32.5 |
| VESA720 | 28.32 | 31.47 | 70.08 | 35 |
| SVGA56 | 36 | 35.16 | 56.25 | 37.5 |
| SVGA60 | 40 | 37.88 | 60.32 | 35 |
| SVGA72 | 50 | 48.08 | 72.19 | 37.5 |
| SVGA75 | 49.5 | 46.88 | 75 | 37.5 |
| XGA60 | 65 | 48.36 | 60 | 35 |
| XGA70 | 75 | 56.48 | 70.07 | 35 |
| XGA72 | 78.08 | 58.1 | 72.08 | 32.5 |
| XGA75 | 78.75 | 60.02 | 75.03 | 35 |

Table 1 shows a case where any of three values of 32.5 MHz, 35 MHz, and 37.5 MHz is used as a value of the data clock. For example, for the input video signal of "XGA60" having a dot clock frequency of 65 MHz, the frequency of the data clock is set to 35 MHz. As described above, in this case, the frequency 32.5 MHz of the dot clock which is twice as high as that of the data clock is not employed.

Figure 3:
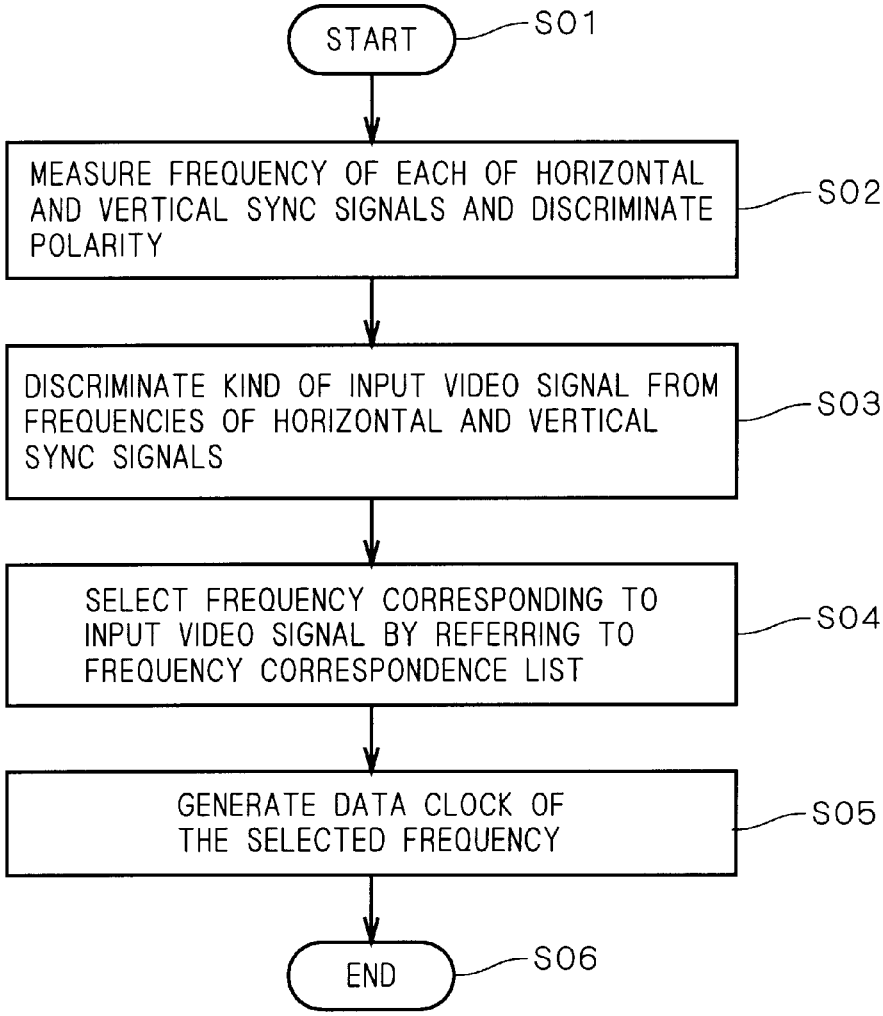
FIG. 3 is a flowchart showing a process of selecting a frequency of the data clock in the image display according to the first preferred embodiment.

FIG. 3 is a flowchart showing the process of selecting the frequency of the data clock $C_d$. First, the input signal discriminating block 3 measures the frequency of each of the horizontal and vertical sync signals and discriminates the polarity of each of the sync signals (step S02). The input signal discriminating block 3 discriminates the kind of the input analog video signal and outputs the result as the signal $S_{ds}$ (step S03). The control block 4 which has received the signal $S_{ds}$ selects the frequency of the data clock $C_d$ used in accordance with the kind of the input analog video signal by referring to the frequency correspondence list (step S04), and controls the data clock generating block 6 by the control information $S_{cd}$. The data clock generating block 6 receives the control information $S_{cd}$ and generates the data clock $C_d$ (step S05).

According to the preferred embodiment, the frequency of the data clock $C_d$ is preset for each kind of the analog video signal $S_{in}$ and the control block 4 selects the preset frequency in accordance with the kind of the input analog video signal $S_{in}$ at the time of control of generating the data clock $C_d$. Consequently, by presetting the data clock frequency at which beat noise is not easily caused for each of the kinds of the analog video signals, the image display in which occurrence of beat noise can be suppressed without adding noise to the image is achieved. Since the frequency of the dot clock of the analog video signal $S_{in}$ and the frequency of the data clock $C_d$ are preset so that one of the frequencies is not equal to or close to an integral multiple of the other, occurrence of beat noise is more suppressed.

In the preferred embodiment, the liquid crystal panel is mentioned as an example of the display unit 7. The display unit may be, for example, a panel portion of a plasma display panel (PDP) or a panel portion of a light emitting diode (LED) display.

Second Preferred Embodiment

A second preferred embodiment is a modification of the image display according to the first preferred embodiment. In the second preferred embodiment, only when there is no change in the input analog video signal $S_{in}$ or input sync signal $S_{sy}$ for preset time, a process of switching the frequency of the data clock $C_d$ is performed. In other words, when the input analog video signal $S_{in}$ or input sync signal $S_{sy}$ continues to be the signal of the same image for a predetermined period, the frequency of the data clock $C_d$ according to the kind of the analog video signal $S_{in}$ is selected.

For example, like at the start of a personal computer, there is a case such that the kind of the input analog video signal $S_{in}$ or input sync signal $S_{sy}$ is switched in extremely short time. The processing speed of the control block 4 may be insufficient and there is a case that the speed of the process of switching the frequency of the data clock $C_d$ does not catch up with the switching speed of the input analog video signal $S_{in}$ or input sync signal $S_{sy}$. In the case where the speed of switching the data clock in correspondence with the input analog video signal or input sync signal which is switched in short time is insufficient, the display screen may be disturbed or remain black to hide a disturbed screen. In order to prevent this, in the preferred embodiment, as described above, only when there is no change in the input analog video signal or input sync signal for a preset period, the process of switching the frequency of the data clock is performed.

Figure 4:
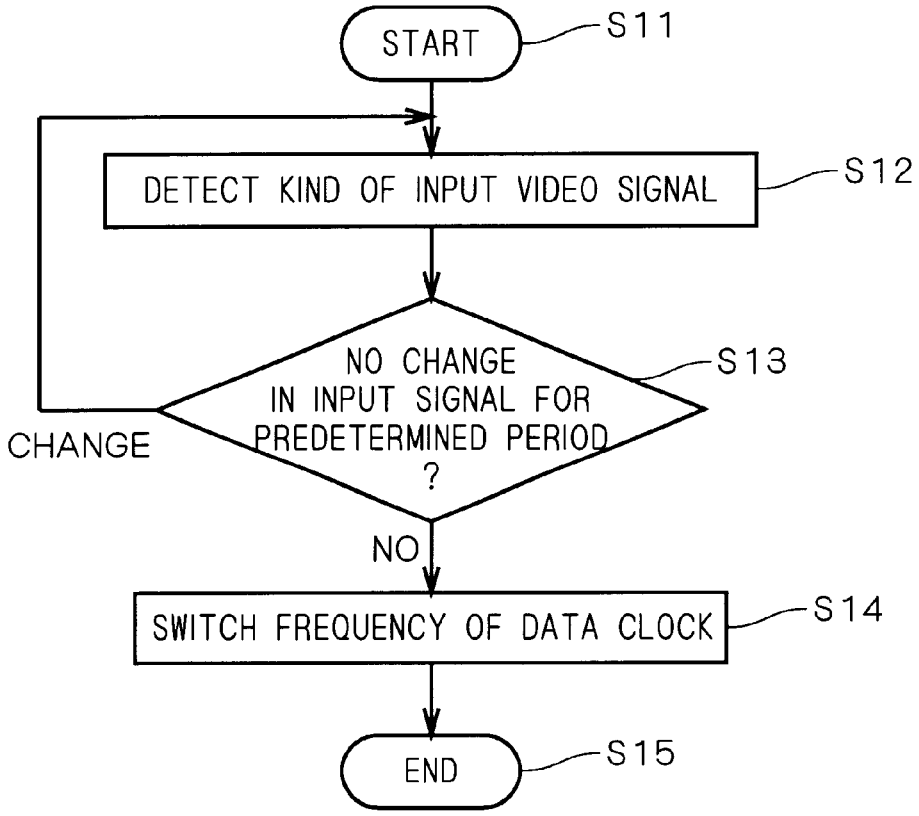
FIG. 4 is a flowchart showing steps of a process of switching the frequency of the data clock in an image display according to a second preferred embodiment.

FIG. 4 is a flowchart showing the process of switching the frequency of the data clock of the preferred embodiment. First, the kind of the input analog video signal is detected by the input signal discriminating block 3 (step S12). Next, for example, by providing the control block 4 with a timer function, whether or not there is a change in the input sync signal $S_{sy}$ during the preset period is monitored by the input signal discriminating block 3 and the control block 4 (step S13). When there is no change in the input sync signal $S_{sy}$ in the preset period, the control block 4 reads the corresponding data clock frequency from the frequency correspondence list and performs the process of switching the frequency of the data clock (step S14). When there is a change, the program returns to step S12 where the kind of the input analog video signal is discriminated.

In the image display according to the second preferred embodiment, only after the input analog video signal $S_{in}$ or input sync signal $S_{sy}$ continues to be the signal of the same image for the predetermined period, the frequency according to the kind of the analog video signal is selected. In the case where the input signal is switched in extremely short time like at the time of start of a personal computer, the display screen can be prevented from being disturbed or remaining black to hide a disturbed screen.

Third Preferred Embodiment

A third preferred embodiment is a modification of the image display according to the second preferred embodiment. The frequency according to the kind of the analog video signal is not selected immediately after the input analog video signal $S_{in}$ or input sync signal $S_{sy}$ continues to be the signal of the same image for a predetermined period but the information of the frequency is once stored in a memory. When the user operates the image display again (when the image display is restarted or when the user once turns off the power and turns on the power of the image display for the next time), the data clock frequency is set to the stored value.

In the second preferred embodiment, the example in which the frequency of the data clock is switched at the time point when it is discriminated that the input signal has not changed for a preset period has been described. However, at the time point, the possibility that the image display is being used by the user is high.

On the other hand, the process of switching the frequency of the data clock makes the display screen disturbed. Consequently, when the user performs the process of switching the frequency of the data clock, the user watches the disturbed display screen and may feel offensive. There is also the possibility that the user misconstrues the disturbed display screen as a failure of the image display.

In the preferred embodiment, therefore, even when it is discriminated that the input analog video signal or input sync signal has not changed for a predetermined period, the process of changing the frequency of the data clock is not immediately performed.

Figure 5:
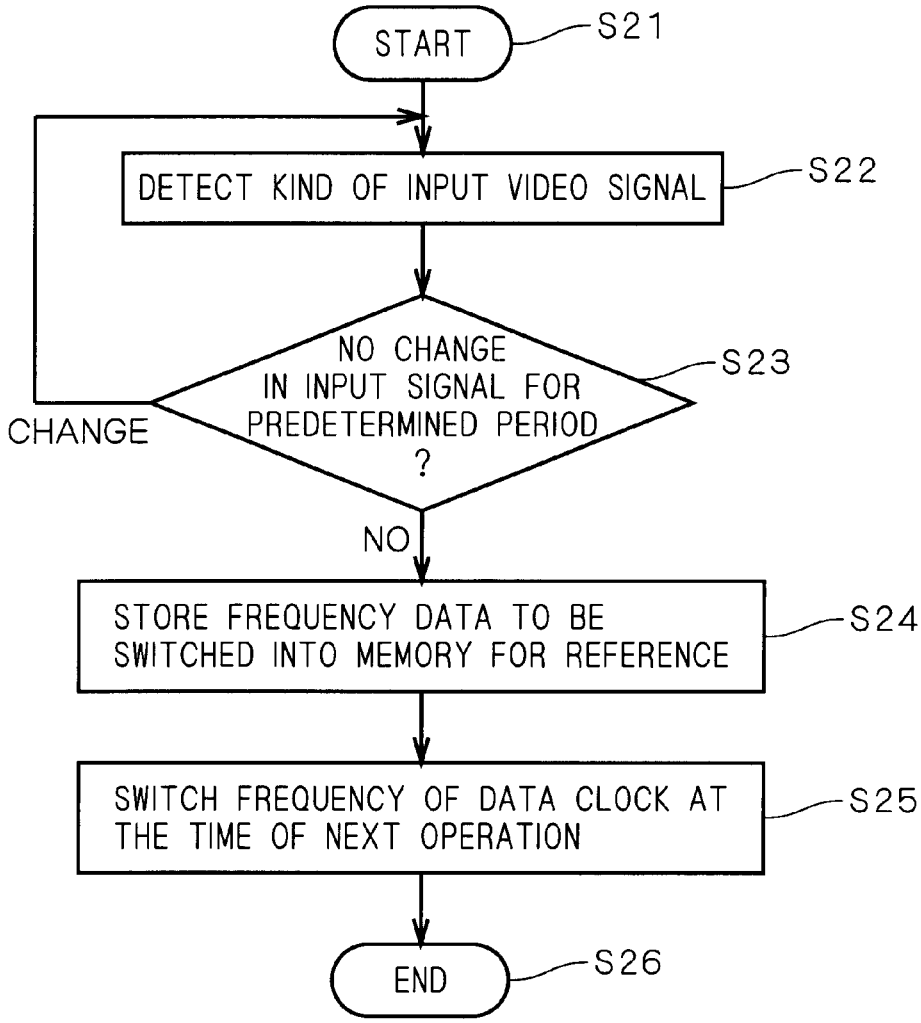
FIG. 5 is a flowchart showing steps of a process of switching the frequency of the data clock in an image display according to a third preferred embodiment.

FIG. 5 is a flowchart showing the process of switching the frequency of the data clock of the image display according to the preferred embodiment.

First, the kind of the input analog video signal is detected by the input signal discriminating block 3 (step S22). By providing, for example, the control block 4 with a timer function, whether there is a change in the input sync signal $S_{sy}$ in the preset period or not is monitored by the input signal discriminating block 3 and the control block 4 (step S23).

When there is no change in the input sync signal $S_{sy}$ in the predetermined period, the control block 4 discriminates that the input analog video signal is a signal mainly used by the user, reads information of the frequency of the data clock corresponding to the input analog video signal from the frequency correspondence list, and once stores the read information into the memory MM (step S24). It is sufficient to employ a nonvolatile memory or the like as the memory MM and provide a writable area. When the image display is operated again, the process of switching the frequency of the data clock is performed (step S25). When there is a change, the program returns again to step S22 where the kind of the input analog video signal is discriminated.

In the image display according to the preferred embodiment, when the analog video signal or input sync signal continues to be the signal of the same image for a predetermined period, the information of the frequency according to the kind of the analog video signal is stored in a storage device, and only when the image display is operated again, the stored frequency is selected. Consequently, even when the user of the image display performs the process of switching the frequency of the data clock, the disturbed display screen is not shown to the user at that time point. Thus, it does not make the user feel offensive or the disturbed display screen is not misconstrued as a failure of the image display.

There is a case that the user switches the kind of the input analog video signal during the use of the image display, such as a case where, when the input analog video signal is a video output from a personal computer, the user changes from the VGA mode to the XGA mode.

Consequently, there is the possibility that a plurality of kinds of input analog video signals or input sync signals which do not change for a predetermined period are generated. In this case, it is sufficient for the control block 4 to update the frequency already stored and newly store the frequency of the data clock corresponding to the latest input analog video signal or input sync signal.

The frequency of the data clock may be updated either each time it is discriminated that the same input signal is continuously inputted for a predetermined period regardless of whether the frequency is the same as the frequency already stored or not, or only when the already stored frequency and the latest frequency are compared with each other and found to be different from each other. In any case, when the user of the image display newly switches the kind of the analog video signal, the latest data clock frequency can be set.

Although the information to be stored in the memory MM is that of the frequency of the data clock in the above, other information such as information of the kind of the input analog video signal or input sync signal may be stored. In this case, when the image display is operated again, the control block 4 reads information of the kind of the input analog video signal stored in the memory MM and selects the frequency of the data clock on the basis of the frequency correspondence list. That is, information stored in the memory MM may be any information as long as it is related to the frequency correspondence list based on which the control block 4 selects the frequency.

Fourth Preferred Embodiment

A fourth preferred embodiment is also a modification of the image display according to the first preferred embodiment. In the fourth preferred embodiment, the kind of the analog video signal is discriminated by using not only the sync signal but also the resolution.

In the first preferred embodiment, the input signal discriminating block 3 discriminates the kind of the analog video signal from the vertical and horizontal sync signals and transmits the discrimination result to the control block 4, and the control block 4 selects the frequency of the data clock according to the kind of the analog video signal. As shown in the vertical and horizontal sync frequencies in Table 1, usually, at least one of the vertical and horizontal sync frequencies in an input video signal is different from that in another input video signal. By measuring the sync frequencies, the kind of the analog video signal can be accurately discriminated and, as a result, the control block 4 can accurately select the frequency according to the kind of the analog video signal by using the discrimination result.

However, a case where both the vertical and horizontal sync frequencies of an input video signal are the same as those of another input video signal can be also considered. In the preferred embodiment, the resolution is also used to discriminate the kind of the analog video signal.

Figure 6:
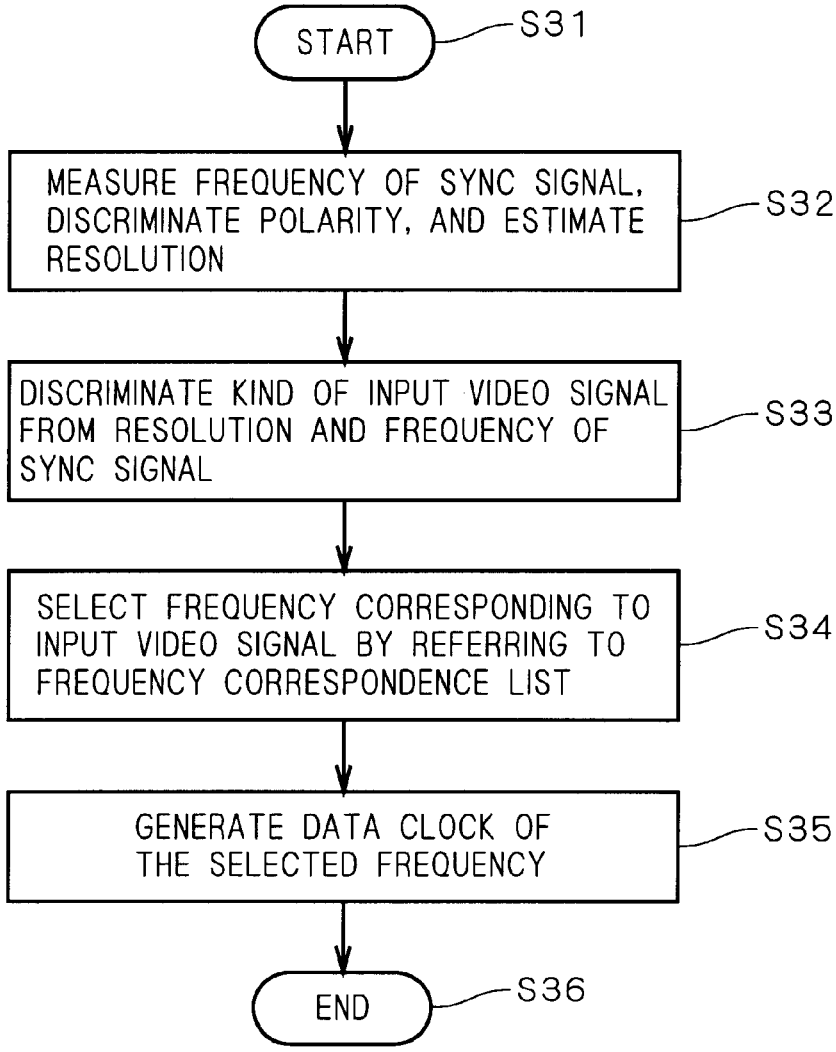
FIG. 6 is a flowchart showing a process of selecting the frequency of the data clock in an image display according to a fourth preferred embodiment.

FIG. 6 is a flowchart showing the process of selecting the frequency of the data clock $C_d$ in the image display of the fourth preferred embodiment. First, the input signal discriminating block 3 measures the frequency of each of the horizontal and vertical sync signals and discriminates the polarity of each of the sync signals. Further, the input signal discriminating block 3 recognizes the input video area and estimates the resolution from the relation between the frequency of each of the horizontal and vertical sync signals and the video area (step S32). Subsequently, the input signal discriminating block 3 discriminates the kind of the input analog video signal from the information of the measured sync frequency and the estimated resolution, and outputs the result as a signal $S_{ds}$ (step S33). The discrimination may be made by properly using a combination of horizontal and vertical components of the sync frequencies and the resolutions, for example, a combination of the horizontal sync frequency and the horizontal resolution or a combination of the vertical sync frequency and horizontal and vertical resolutions. In such a manner, the possibility that the sync frequency and the resolution are the same and it is difficult to make discrimination is little.

The control block 4 which has received the signal $S_{ds}$ selects the frequency of the data clock $C_d$ used in accordance with the kind of the input analog video signal by referring to the frequency correspondence list (step S34), and controls the data clock generating block 6 by the control information $S_{cd}$. The data clock generating block 6 receives the control information $S_{cd}$ and generates the data clock $C_d$ (step S35).

In the image display according to the preferred embodiment, the input signal discriminating block 3 further estimates the resolution of the analog video signal from the sync signals and discriminates the kind of the analog video signal by also using the information of the resolution. Thus, the frequency according to the kind of the analog video signal can be accurately selected.

Fifth Preferred Embodiment

A fifth preferred embodiment is also a modification of the image display according to the first preferred embodiment. In the fifth preferred embodiment, the frequency of the data clock can be arbitrarily set from the outside.

Figure 7:
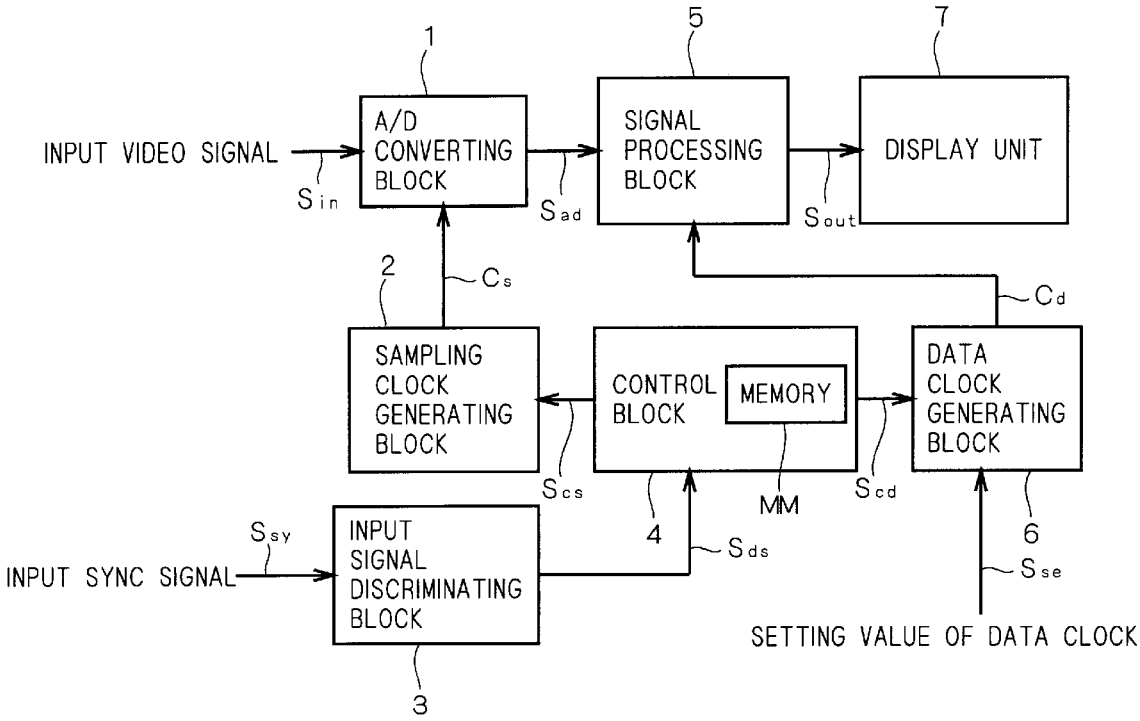
FIG. 7 is a diagram showing an image display according to a fifth preferred embodiment.
Figure 8:
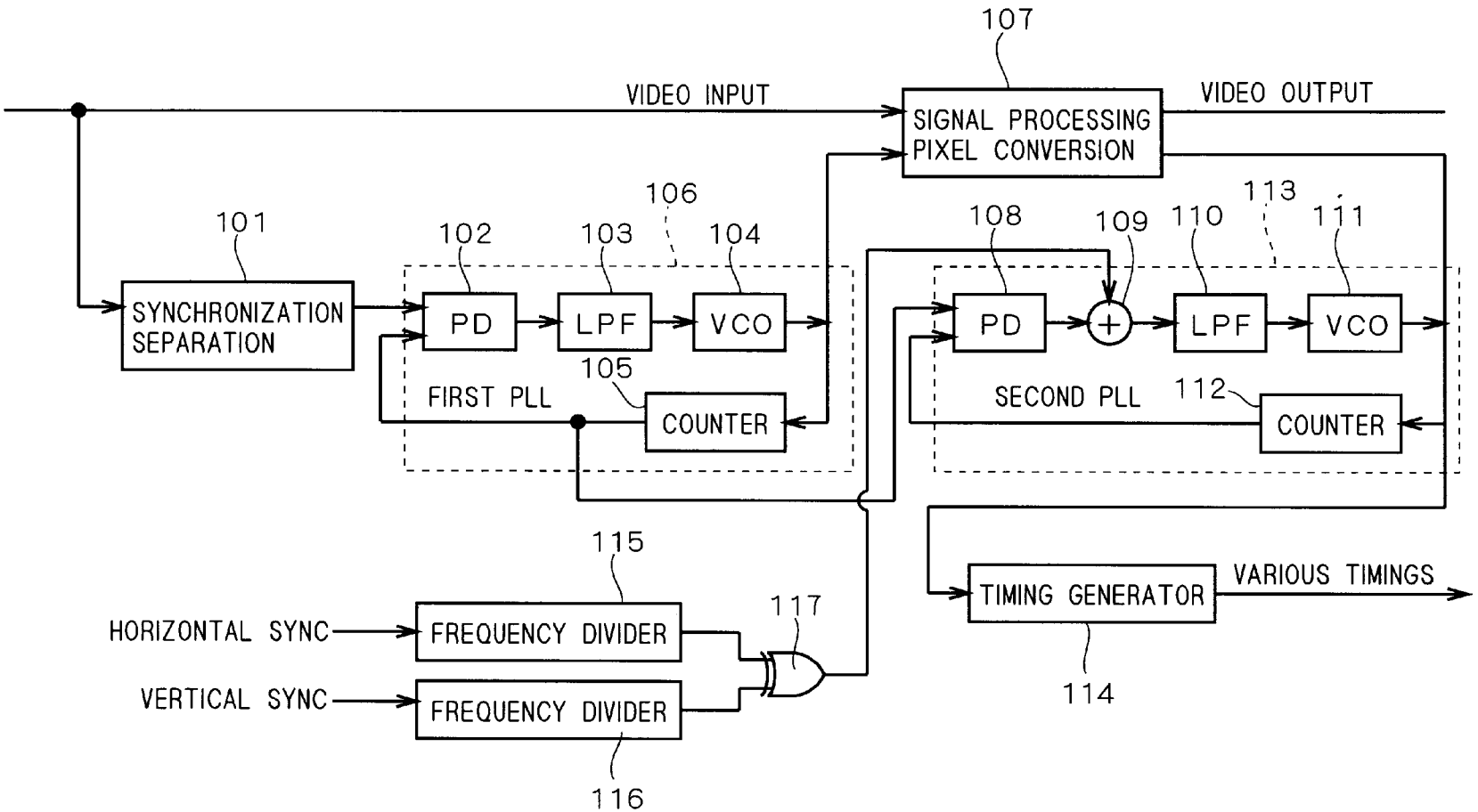
FIG. 8 (PRIOR ART)
FIG. 8 is a diagram showing a conventional image display.

FIG. 7 is a diagram showing an image display according to the preferred embodiment. In FIG. 7, components similar to those of the image display of the first preferred embodiment are designated by the same reference numerals. As shown in FIG. 7, in the image display of the preferred embodiment, in addition to the construction of the image display of the first preferred embodiment, a signal $S_{se}$ can be supplied as a data clock setting value to the data clock generating block 6. When the signal $S_{se}$ is received, the data clock generating block 6 generates a data clock of an arbitrary frequency set by the user irrespective of the setting of the frequency of the data clock for each kind of the analog video signal in the frequency correspondence list.

When the frequency of the data clock can be arbitrarily set from the outside as described above, the user can set the frequency of the data clock in an optimum state while checking the image and the state of beat noise.

While the invention has been shown and described in detail, the foregoing description is in all aspects illustrative and not restrictive. It is therefore understood that numerous other modifications and variations can be devised without departing from the scope of the invention.

What is claimed is:

1. An image display comprising:

an A/D converting unit for receiving an analog video signal and sampling said analog video signal by using a sampling clock, thereby converting said analog video signal into a first digital video signal;

a signal processing unit for performing a pixel converting process on said first digital video signal by using a data clock for specifying resolution after the pixel converting process to thereby generate a second digital video signal;

a display unit for receiving said second digital video signal and displaying an image; and a control unit for controlling generation of said sampling clock and generation of said data clock, wherein a frequency of said data clock is preset for each kind of said analog video signal, and said control unit selects the frequency of said data clock on the basis of said presetting at the time of controlling the generation of said data clock.

2. The image display according to claim 1, wherein said analog video signal is supplied as a dot train, and a frequency of a dot clock for specifying a period of said dot train of said analog video signal and a frequency of said data clock are set so that one of the frequencies is not an integral multiple of the other.

3. The image display according to claim 1, wherein said control unit executes said selecting operation only after said analog video signal or a sync signal of said analog, video signal continues to be the signal of the same image for a predetermined period.

4. The image display according to claim 1, further comprising a writable storage device, wherein when said analog video signal or the sync signal of said analog video signal continues to be the signal of the same image for a predetermined period, said preset information based on which said control unit performs said selecting operation is stored in said storage device, and only when said image display is operated again, said control unit executes said selecting operation on the basis of said information.

5. The image display according to claim 4, wherein when said preset information based on which said control unit performs said selecting operation is already stored in said storage device, said preset information is updated and stored in said storage device each time said analog video signal or said sync signal continues to be the signal of the same image for a predetermined period.

6. The image display according to claim 4, wherein when said preset information based on which said control unit performs said selecting operation is already stored in said storage device, each time said analog video signal or said sync signal continues to be the signal of the same image for a predetermined period, new information is compared with said information already stored, and when the new information is different from said information already stored, said storage device is updated to the new information.

7. The image display according to claim 1, further comprising an input signal discriminating unit for receiving the sync signal of said analog video signal, discriminating the kind of said analog video signal from said sync signal, and transmitting the discrimination result to said control unit, wherein said control unit executes said selecting operation by using said discrimination result.

8. The image display according to claim 7, further comprising:

a sampling clock generating unit for generating said sampling clock under control of said control unit on the basis of said discrimination result; and a data clock generating unit for generating said data clock under control of said control unit on the basis of said discrimination result.

9. The image display according to claim 1, further comprising a storage device, wherein information of the frequency of said data clock preset for each kind of said analog video signal is stored as a frequency correspondence list in said storage device.

10. The image display according to claim 1, wherein said frequency can be arbitrarily set irrespective of the preset frequency of said data clock for each kind of said analog video signal.

11. A method for displaying an image, comprising:

discriminating an image type of an analog input video signal;

generating a sampling clock and a data clock based on said image type, wherein a frequency of said data clock is preset for each image type;

converting said analog input video signal to a first digital video signal based on said sampling clock;

converting said first digital video signal to a second digital video signal based on said data clock; and displaying said second digital video signal.

12. The method of claim 11, wherein the discriminating step comprises discriminating the image type based on horizontal and vertical sync frequencies of said analog input video signal.

13. The method of claim wherein the generating step comprises generating said data clock after said image type of the analog input video signal remains constant for a preset amount of time.

14. The method of claim 13, wherein the generating step comprises:

selecting a frequency of said data clock after said image type of the analog input video signal remains constant for a preset amount of time; and generating said data clock of said frequency after an image display is newly operated.

15. A The method of claim 11, wherein the generating step comprises:

receiving a data clock setting from an external source; and generating said data clock based on said setting.

16. A device for displaying images, comprising:

an image type discriminator configured to discriminate an image type of an analog input video signal;

a sampling clock generator configured to generate a sampling clock based on said image type;

a data clock generator configured to generate a data clock based on said image type, wherein a frequency of said data clock is preset for each image type;

a first video converter configured to convert said analog input video signal to a first digital video signal based on said sampling clock;

a second video converter configured to convert said first digital video signal to a second digital video signal based on said data clock; and a display configured to display said second digital video signal.

17. The device of claim 16, wherein said image type discriminator is configured to discriminate said image type based on horizontal and vertical sync frequencies of said analog input video signal.

18. The device of claim 16, wherein said data clock generator is configured to generate said data clock after said image type of the analog input video signal remains constant for a preset amount of time.

19. The device of claim 18, wherein said data clock generator is configured to select a frequency of said data clock after said image type of the analog input video signal remains constant for a preset amount of time and to generate said data clock of said frequency after said image display is newly operated.

20. The method of claim 16, wherein said data clock generator is configured to receive a data clock setting from an external source and to generate said data clock based on said setting.

* * * * *

UNITED STATES PATENT AND TRADEMARK OFFICE

CERTIFICATE OF CORRECTION

PATENT NO. : 6,704,009 B2
DATED : March 9, 2004
INVENTOR(S) : Tachibana et al.

It is certified that error appears in the above-identified patent and that said Letters Patent is hereby corrected as shown below:

Title page,
Item [56], References Cited, FOREIGN PATENT DOCUMENTS, please add:
-- KR 1998-014893 5/1998 -- and -- KR 1997-0071446 11/1997 --

Signed and Sealed this

Twenty-seventh Day of July, 2004

JON W. DUDAS
*Acting Director of the United States Patent and Trademark Office*